US006502406B2

(12) United States Patent
Niehaus

(10) Patent No.: US 6,502,406 B2
(45) Date of Patent: Jan. 7, 2003

(54) DEVICE FOR COOLING AND TAPPING

(76) Inventor: Joachim Niehaus, Kleinbahnring 38, D-59469 Ense-Niederense (DE)

( * ) Notice: Subject to any disclaimer, the term of this patent is extended or adjusted under 35 U.S.C. 154(b) by 0 days.

(21) Appl. No.: 09/955,156

(22) Filed: Sep. 19, 2001

(65) Prior Publication Data

US 2002/0043069 A1 Apr. 18, 2002

(30) Foreign Application Priority Data

Sep. 19, 2000 (DE) ..... 100 46 526

(51) Int. Cl.[7] ..... F25B 21/02; F25D 3/08; B65D 35/56

(52) U.S. Cl. ..... 62/3.64; 62/457.4; 222/105

(58) Field of Search ..... 62/3.64, 337, 338, 62/339, 394, 395, 396, 397, 457.4, 457.8, 457.9; 222/105, 146.6, 399, 61, 83

(56) References Cited

U.S. PATENT DOCUMENTS 4,580,405 A * 4/1986 Cretzmeyer, III ..... 62/457.4
4,921,135 A * 5/1990 Pleet ..... 222/105
5,966,964 A * 10/1999 Pattee ..... 62/457.4
6,141,969 A * 11/2000 Launchbury et al. ..... 62/3.4

FOREIGN PATENT DOCUMENTS

DE 19720553 C2 7/1999

* cited by examiner

*Primary Examiner*—Chen-Wen Jiang
(74) *Attorney, Agent, or Firm*—Venable; Norman N. Kunitz

(57) ABSTRACT

A device for cooling and tapping of beverages that are delivered in containers. It integrates a cooling unit to an insulated casing. Inside the casing a cooling volume is formed, that is closed by a bonnet. The cooling volume is formed as a tub. Beverage containers are inserted into this tub. The casing is swivel-mounted on a stand and is equipped with a tapping unit.

27 Claims, 11 Drawing Sheets

DEVICE FOR COOLING AND TAPPING

BACKGROUND OF THE INVENTION

The invention relates to a device for cooling and tapping of beverage stored in containers, provided with a casing which integrates a cooling unit and a cooling volume and is sealable with a bonnet.

Devices for cooling beverage are known in many different kinds and we can make a distinction between passive cooled devices and active cooled devices. Passive cooling means that cooling-aids are used in the device. Cooling-aids usually are containers that are filled with a fluid and are stored in a freezer before being inserted into the device. After insertion into the device, the cooling aids emit their stored cold to the beverage inside the device. When using active cooling, the devices are equipped with a cooling unit which produces cold by consuming energy. This is mainly realized with the use of electrical cooling compressors.

These known devices are usually suited only for transport and storage of beverage containers. Furthermore the beverage container must provide a relative high strength to allow a standing accommodation of the containers. For tapping the beverage it is mandatory to open the device and to take the beverage container out of the device before tapping. Afterwards the device must be opened again to reinsert the container. The disadvantage is, that while opening the device two times for tapping the beverage, a great amount of cold escapes from the device and causes important waste of power. Additionally the handling of such a device is not handy. For other devices it is mandatory to fill in the beverage directly into a tank inside the device. This causes a hygienic problem when using perishable beverage and handicaps cleaning of these devices.

SUMMARY OF THE INVENTION

It is the object of the invention to provide a device for cooling of beverage stored in containers having either a solid structure or a flexible structure and allowing to tap the beverage without opening the device. In accordance with the invention, this object is accomplished in that the cooling volume is designed in the shape of a tub, the casing is swivel-mounted to the stand and the device is provided with a tapping-unit.

This invention embodies a device for cooling of beverage stored in solid or in flexible containers. The beverages stay inside their containers and have no contact to the device or its units, providing a maximum of hygiene especially in combination with the use of non-returnable containers. Furthermore the beverage can be tapped without opening the device. This and a special insulation of the device improves the heat-balance of the device in comparison to the known devices and allows a substantially lower power consumption of the cooling unit.

In a modification of the invention, the active cooling unit is designed as a peltier element combined with a water cooler. Peltier elements are electrical devices that generate a temperature difference from electric current by use of the peltier-effect. Peltier elements are known as active cooling devices. However these known devices work in combination with air cooling, which is ineffective and degrades the cooling effect, especially in combination with higher environment temperatures. Under these circumstances, the cooling capability may low down to zero. The use of a water cooler substantially improves the cooling effect of the peltier element. The cooling water can be taken from beer cooling units usually installed in bars or restaurants. It is also possible to use cooling water from a separate cooling box. The cooling water can have normal room temperature which simplifies the installation of the supply tubing.

In another modification the cooling unit consists of a jacked filled with a fluid having a very low freezing-point. This fluid-jacket-cooling provides a very high cooling power and is usable not only for keeping cool but also for quick cooling down of beverages.

Another modification allows a passive cooling by use of cooling aids which makes the device mobile. Dependent on the special insulation of the device and in combination with an electronic temperature surveillance, a timely change of the cooling aids and a continuos cooling effect is possible.

In the embodiment of the invention, the casing is swivel-mounted to the stand. This embodiment incorporates the advantage, that the tapping can be expedited by pivoting the casing in the direction of the tapping unit. Furthermore it is possible to store fruit juice containing pulp without the use of a stirring unit inside the machine. These stirring units are mandatory for known devices to prevent the fruit pulp from depositing on the floor of the container. The invention allows mixing up the juice and dispersing the temperature by swiveling the casing on the stand. By this movement the beverage is shaken together with the refrigerator and the cooling engine.

The three cooling methods, peltier, fluid-jacket and passive cooling are not affected by the shaking process. Advantageously the stand is provided with shock absorbing stop and backstop. These stops allow a well defined angle of movement for the casing.

As a distinct from other known devices, no compressor is used inside the machine. This allows a small and space saving design and the possibility to shake the casing.

An advantageous free usable space below the device is achieved by positioning the casing on a stand.

In an advantageous embodiment the casing contains an insulation. By providing an insulation the heat-balance of the device is improved. Only little cold can escape while the bonnet is closed.

In a modification of the invention, the tapping unit consists of a commercial tap, that is normally shipped together with the beverage container as a one-way part .In combination with a special lever-assembly, it provides a convenient way of tapping fluid from the container, without the need of opening the casing.

In a second advantageous modification the tapping unit integrates a passage and a lever inside a housing. The lever actuates a clamping notch via a linkage. This modification is used in the case that a drain tube is attached to the beverage container. The drain tube is guided by the passage and is clamped or opened by the notch when the lever is actuated. This device is also serviceable without opening the casing and thus does not influence the heat-balance.

In distinction to other known devices for tapping juices like flow-trough-cooling devices, the whole content is cooled steadily, which improves hygiene, saves perishable fluids and allows to tap great amounts of cold fluid in a short time.

In an advantageous embodiment the tapping unit is positioned low at the front face of the device. Due to this embodiment the tapping unit is at the lowest level of the fluid and ensures simple and reliable emptying of the container.

In distinction to other known devices, the partition of the casing is not plain but is designed L-shaped in its vertical section, to fixate the beverage container while pivoting the device and to ease the handling when changing containers.

Advantageous, a temperature-sensor is applied directly to the tub. By means of this sensor and an electronic controller, the temperature inside the casing can be surveilled and/or regulated.

Advantageous, at least one warning-lamp is attached to the casing. These warning-lamps inform the operators in the case of a malfunction or if the temperature inside the casing exceeds the given limits.

Samples of the invention are shown in the drawings and are described detailed in the following.

DETAILED DESCRIPTION OF THE INVENTION

Figure 1:
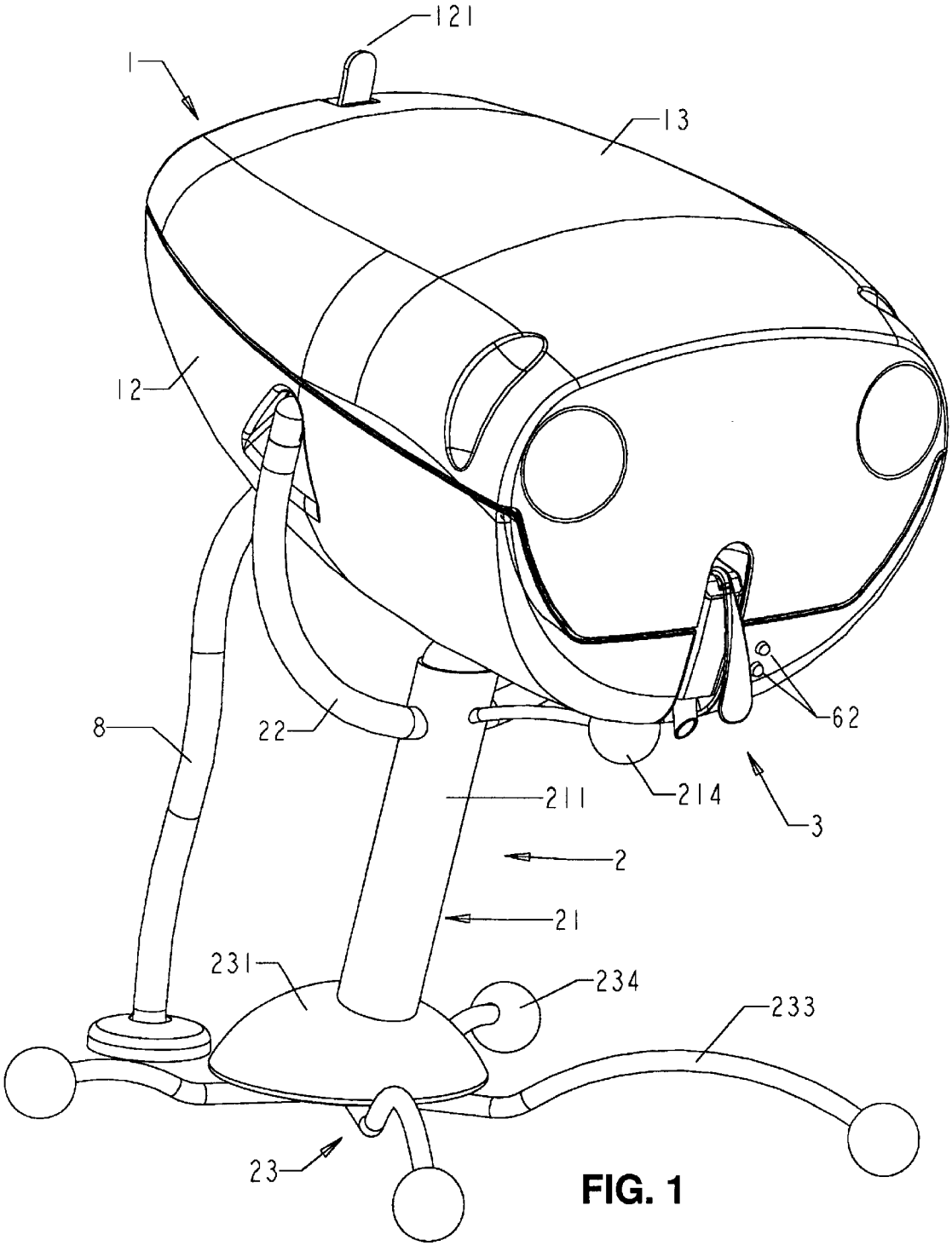
FIG. 1 a perspective front view of a device.
Figure 2:
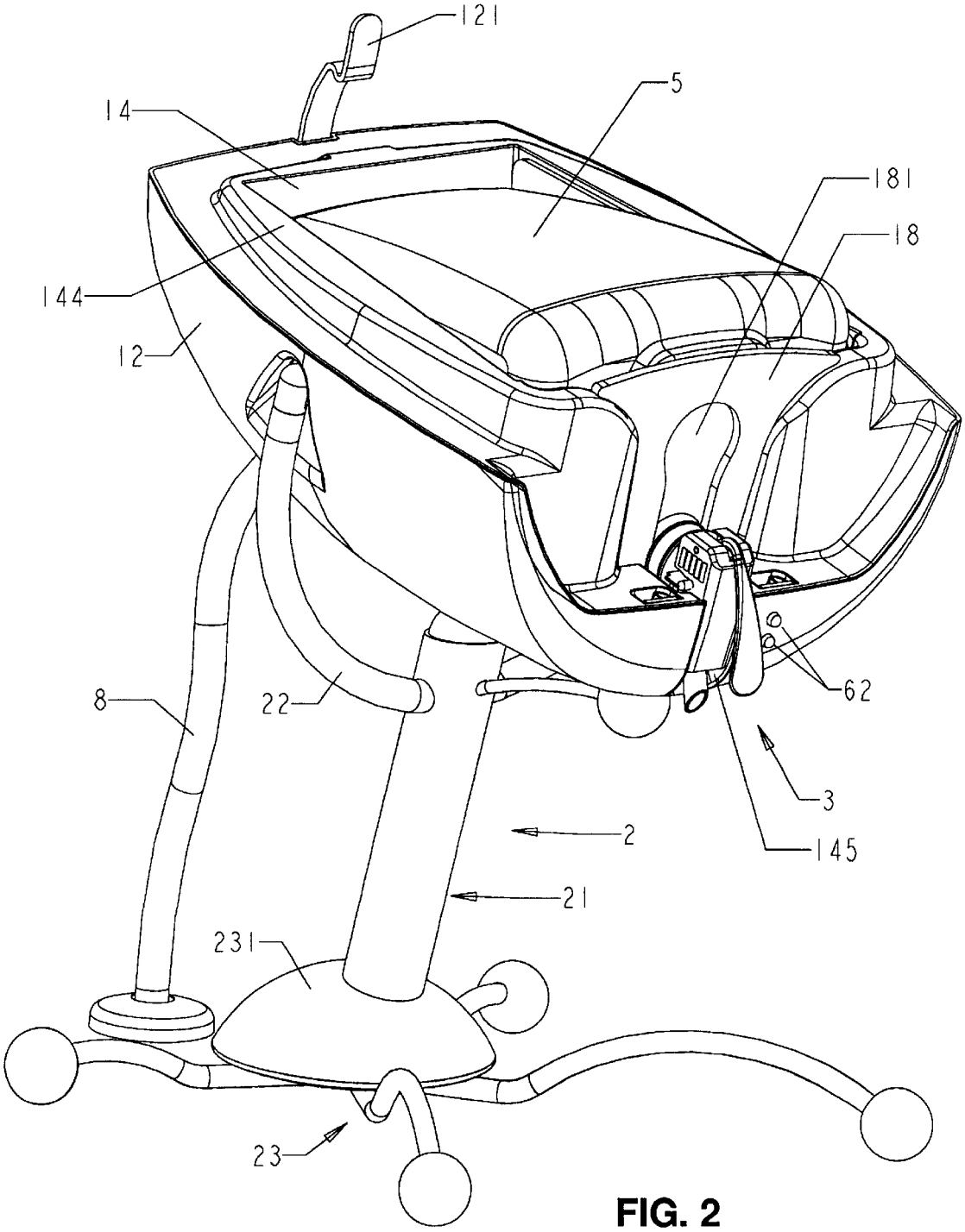
FIG. 2 the device shown in FIG. 1 with its bonnet removed.
Figure 3:
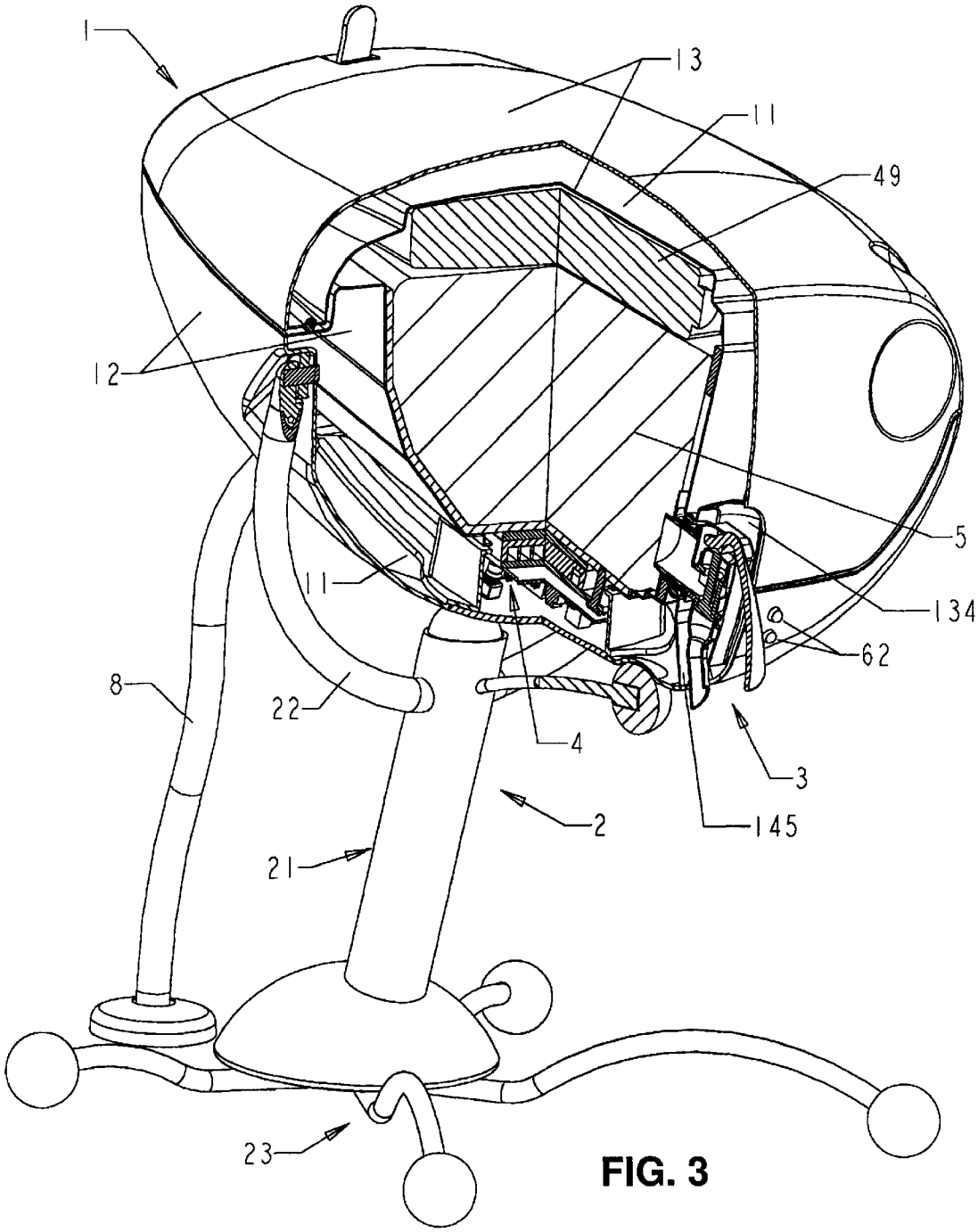
FIG. 3 the device shown in FIG. 1 in a partial section with additionally inserted cooling aid.
Figure 4:
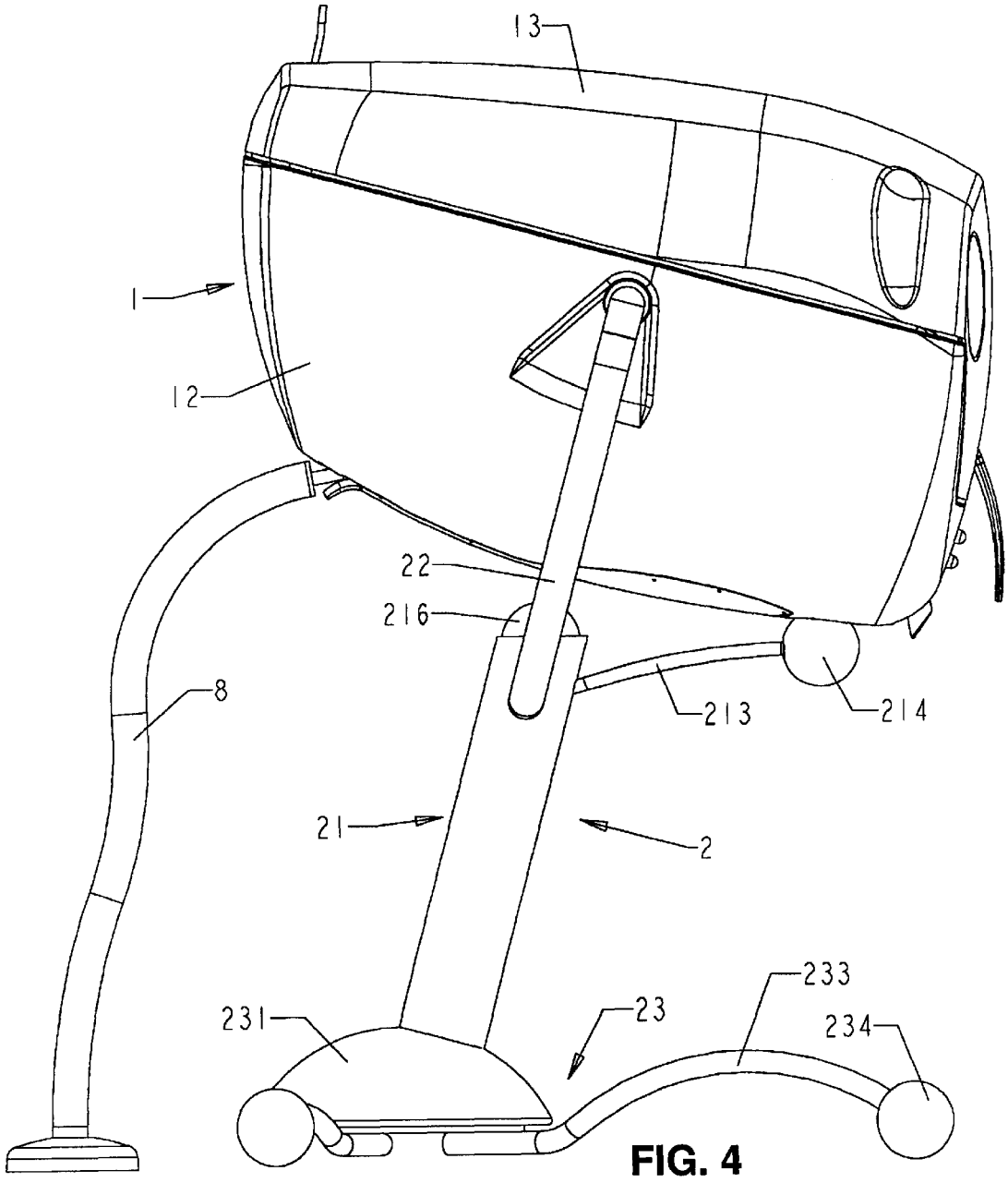
FIG. 4 a side view of the device in FIG. 1 pivoted to its front stop position.
Figure 5:
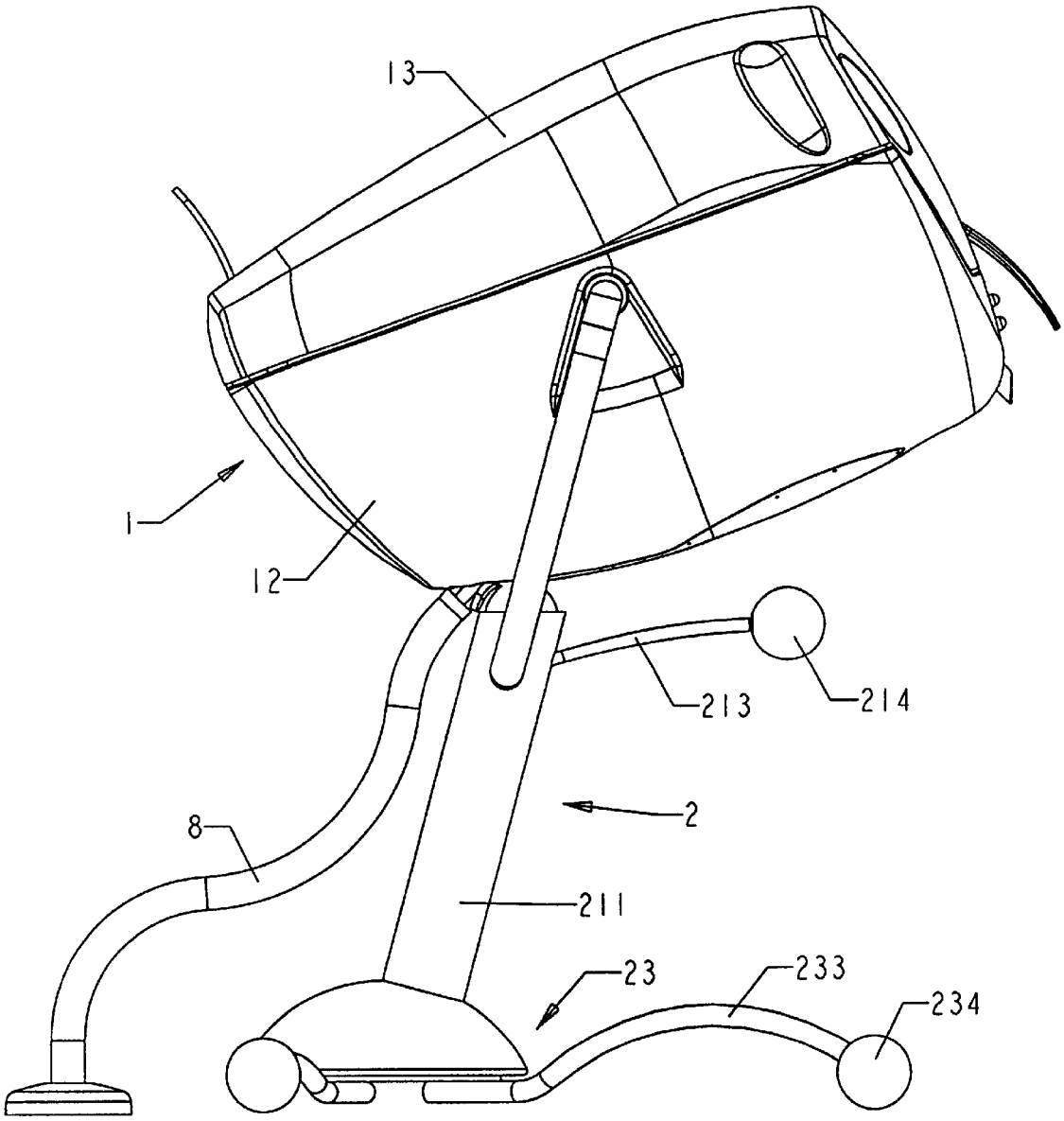
FIG. 5 a side view of the device in FIG. 1 pivoted to its backstop position.

The first sample according to FIG. 3 uses peltier technology and is preferably used to keep cold precooled beverage. It consists of a casing 1 which is swivel-mounted to a stand 2 and provided with a tapping unit 3. The casing 1 integrates a cooling unit 4. It holds beverage-containers 5.

The casing 1 shows a compact barrel- or drop-shaped form. Its skin is made of plastics and encloses an insulation 11, made of polyurethane-, epoxy- or polystyrene-foam. The casing provides a cooling volume and consists of a lower part or body 12 and an upper part or bonnet 13. The insulation 11 fills the whole space in between the outer and the inner shells of these two parts.

Both parts of the casing 1 are hollow parts made of two laminated plastic shells and entirely filled with the insulation 11 which is not separately shown in the drawings.

The partition of the casing is designed without a plain sealing surface in between the bonnet 13 and the body 12 but instead with an L-shaped bonnet. This bonnet 13 not only serves to close the casing but also fixes the position of the flange pipe 52 in its correct position in the keyhole-opening 181 (FIGS. 2,3,6,7). This securing is especially advantageous when using flexible containers 5. The flange-pipe 52 is securely fixed even while shaking the casing 1 so the beverage containers can not move. Another preference is the better handling when changing containers.

Bonnet 13 and body 12 have only the smallest possible cutout 134, 135, 145 and 126 for the integration of the tapping unit 3. This lows down the loss of cold in this region due to the absence of insulation (FIGS. 3, 6 and 7).

Figure 6:
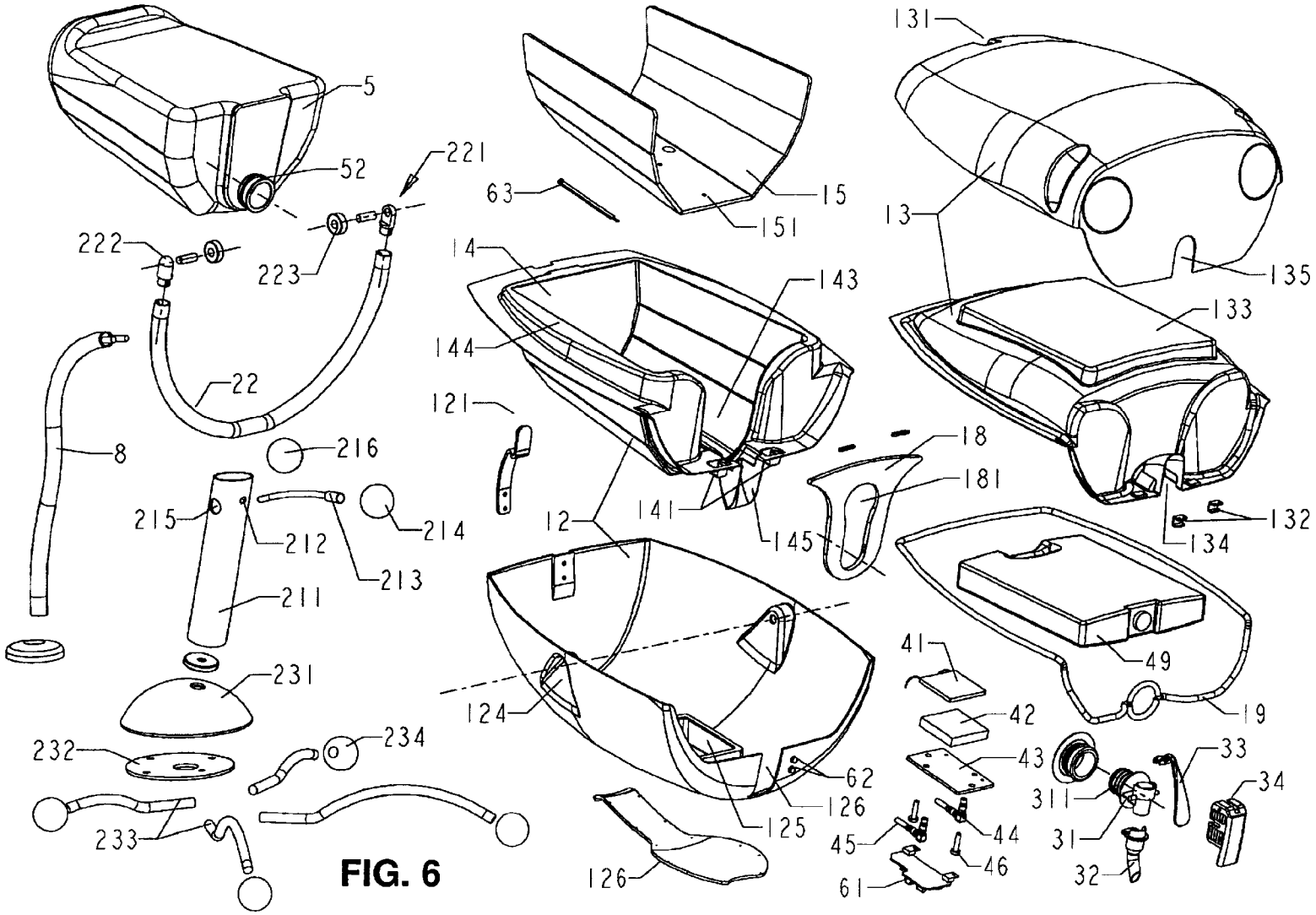
FIG. 6 a device containing a peltier-cooler and additional cooling aid in an exploded view.
Figure 7:
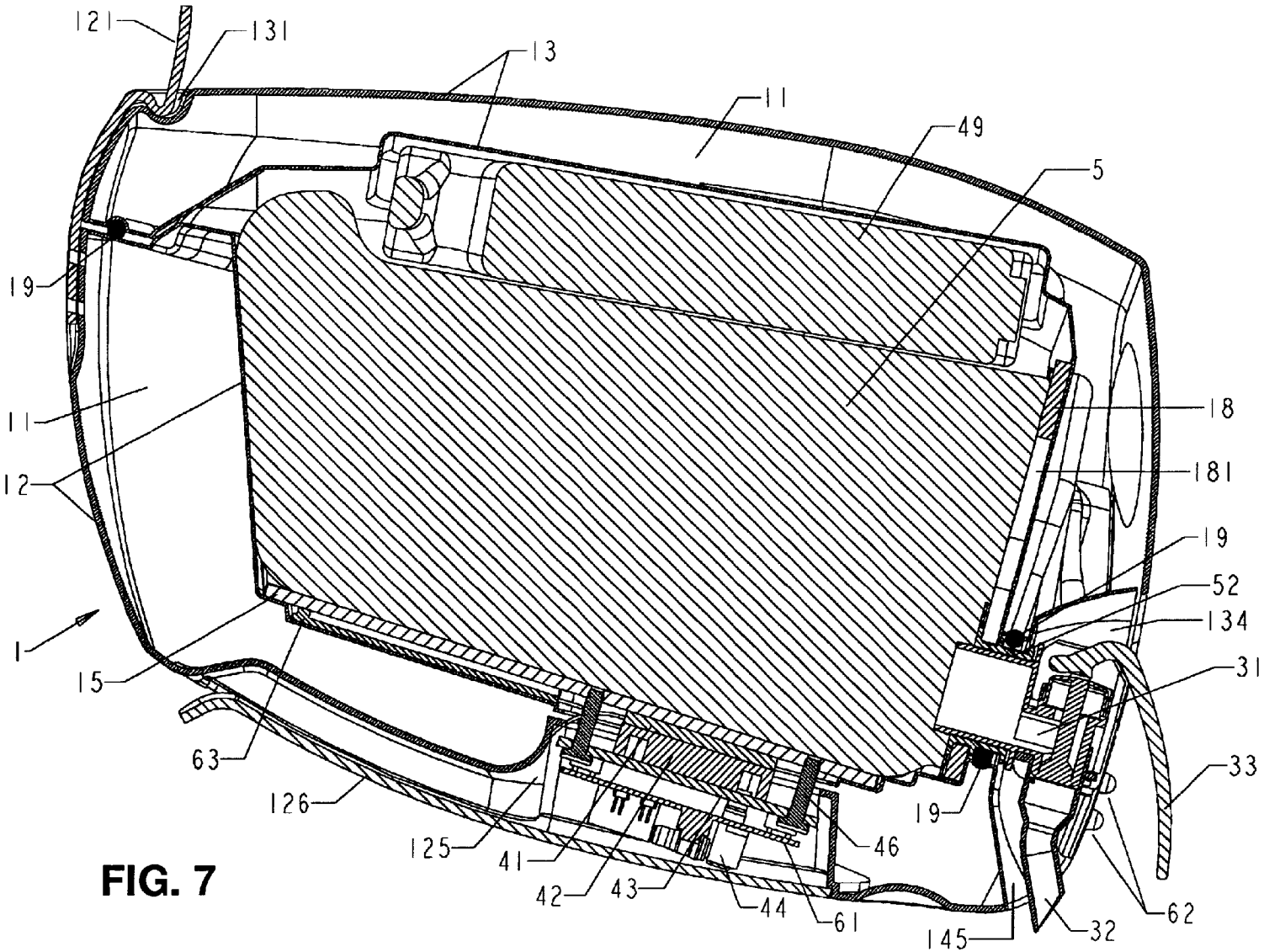
FIG. 7 a section along the longitudinal axis of a device shown in FIG. 1, 3 to 6.

For locking the bonnet 13, a closing lever 121 is fixed to the back face of the body 12 (FIG. 7). This lever fits into a cam 131 which is integrated into the bonnet 13. At the front, two hooks 132 are fixed to the bonnet (FIG. 6), which are inserted into mountings 141 at the inner part 14 of the body 12.

The cooling tub 15, made from aluminum is inserted into the inner shell 14. The cooling unit that consists of the peltier element 41, the water cooler 42 with cover 43 and the water source and drain 44/45, is fixed to the aluminum tub 15 by means of two plastic screws 46. The cooling volume is covered with the bonnet 13. Beverage containers 5 are inserted into this cooling volume. The body 12 is provided with a border 144 which helps to secure the position of the containers 5. A sealing cord 19 is attached along the border 144. A reception wall 18 is fixed in the cutout 143 of the inner shell part 14. Into this wall a cutout 181 is formed like a keyhole and secures the position of the flange-pipe 52 of the beverage containers 5. At the underside of the body 12 a reception 125 for the cooling unit 4 and the electronic controller 61 is provided. This reception 125 can be closed with a cover 126. The inner temperature sensor 63 is mounted directly to the aluminum tub 15. At the front face of the body 12 two signal-LEDs 62 are provided for indicating the temperature of the beverage and the cooling fluid. One of these can also indicate the need for shaking the device.

According to the sample shown in FIGS. 6 and 7 the cooling unit 4 consists of a peltier element 41 attached to a water cooler 42. An external cooling-fluid storage with a cooling unit (not shown in the drawings) is connected by means of the tube connectors 44 (source) and 45 (drain) and the tubing 8, to form a cooling circuit. The peltier element and the water cooler are fixed to the tub 15 by means of two plastic screws and a cover plate 43. The peltier element 41 has direct contact to the aluminum tub 15 that leads the produced cold with little delay to the closefitting beverage container 5. The water cooler transfers the heat, produced by the warm side of the peltier element, to the water.

Figure 10:
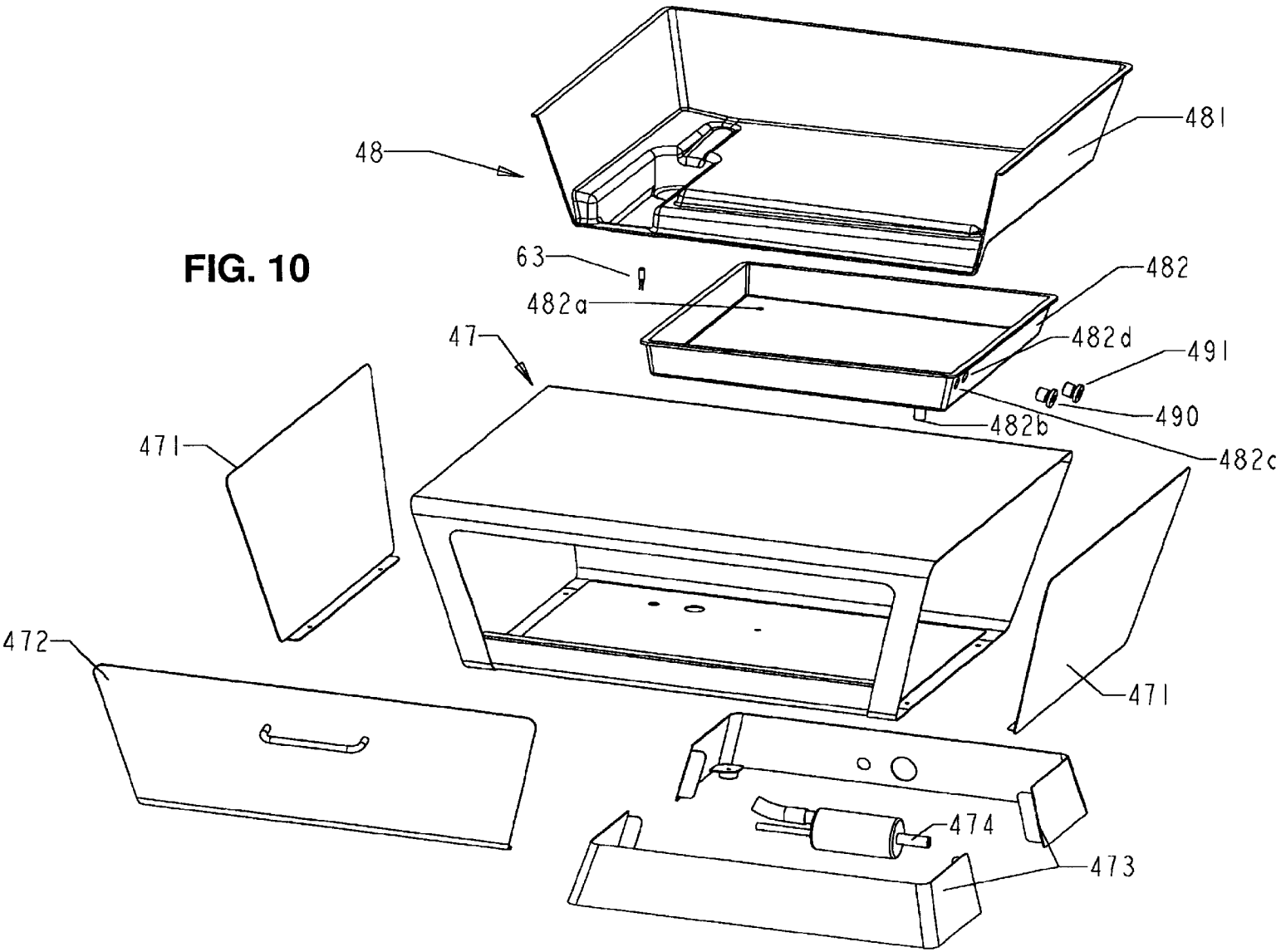
FIG. 10 an exploded view of a service-box.

The cooling water can be taken either from a beer cooling unit which is usually present in bars or restaurants or from a service box according to FIG. 10. This box consists of a housing 47 with side covers 471, a socket 473 and an access door 472. Inside the box exists a cooling volume 48 built from an inner tray 481 laminated to a cooling water container 482. The tubing 8 of the cooling device is attached to the service box via the connectors 482*a* and 482*b*. In one of the tubes a pump 474 is provided that drives the water circuit. The water circuit is filled up through the run-in pipe 482*c* and the ventilation pipe 482*d*. In function these pipes are closed with screws 490 and 491. The volume in between housing 47 and cooling volume 48 is insulated.

For cooling purpose a cooling aid or a frozen beverage container 5 is inserted into the service box. The form of the cooling volume fits to the container 5. The cooling liquid transports the cold from the melting container inside the service box to the warm side of the peltier element. The temperature of the melting beverage can be surveilled with the temperature sensor 63.

By this process, the energy of the melting process is used in an energy circuit for cooling of the beverage container 5 inside the device.

Figure 8:
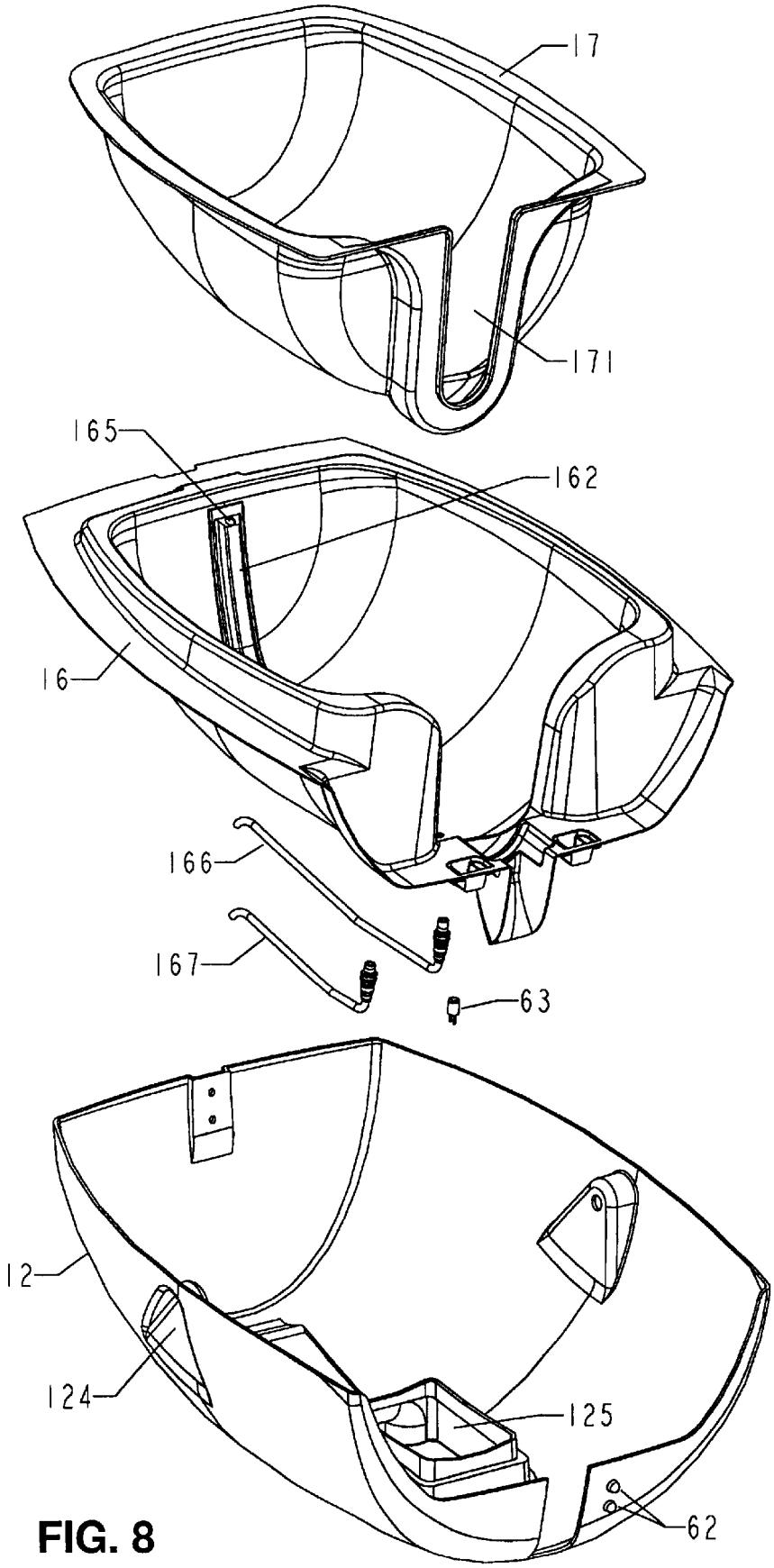
FIG. 8 the body of a device equipped with fluid-jacket-cooling in exploded view.
Figure 9:
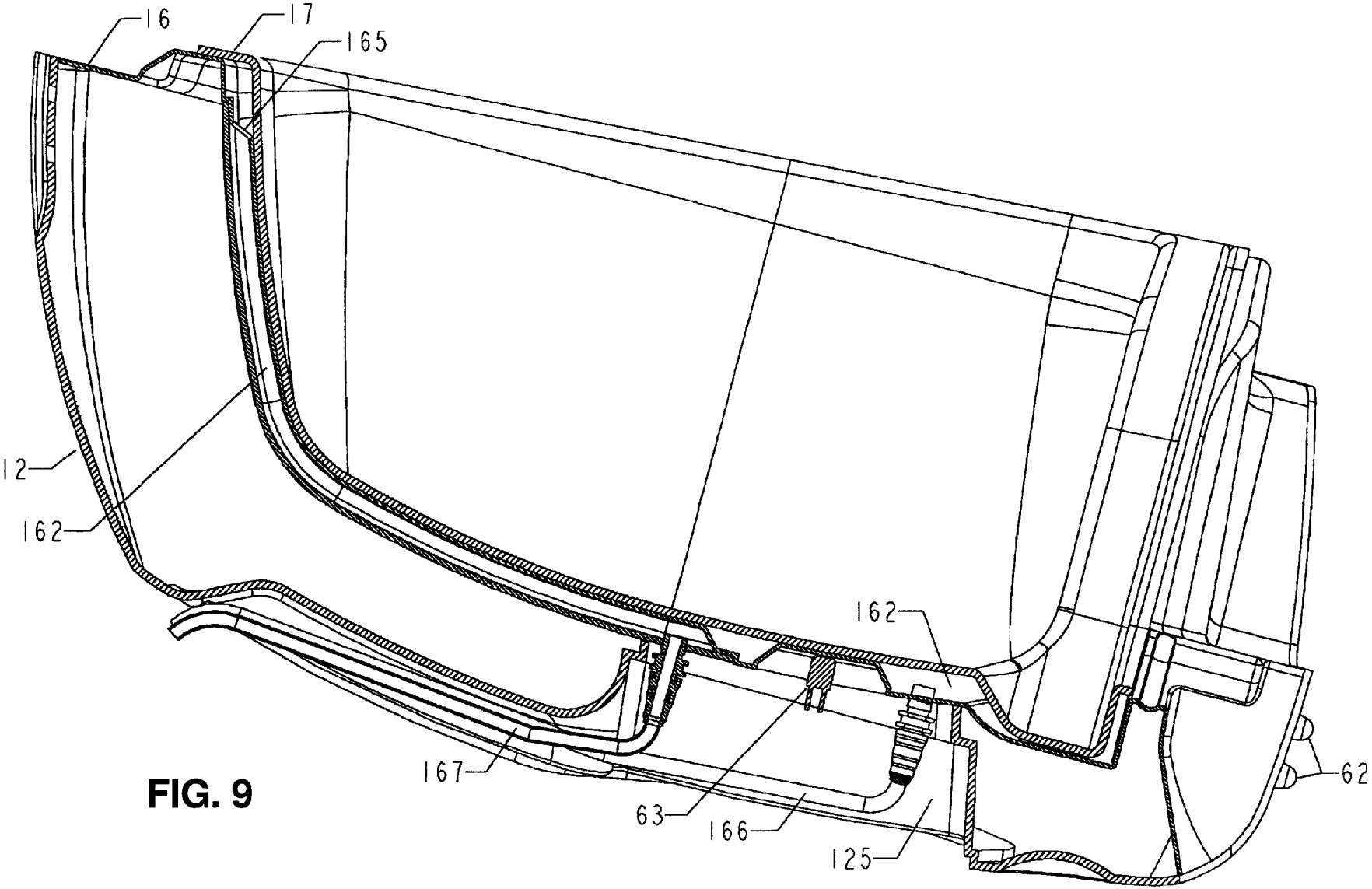
FIG. 9 a section along the longitudinal axis of the device shown in FIG. 8.

The sample with fluid-jacket-cooling shown in FIGS. 8 and 9 uses water with a high percentage of anti-freezing agent to be capable to deliver extremely low temperatures from a freezer to the device. This type of fluid-jacket-cooling makes it possible, to cool down beverages quickly. This sample differs from the one mentioned above in the following. Instead of the inner shell 14 the outer jacket 16 is laminated to the body 12. The inner jacket 17 made of plastics or aluminum is laminated water-proofed to this outer jacket 16. The aluminum tub 15 and the greater part of the cooling unit are not used in this case. Cooling is done by the cooling liquid that enters the volume in between the jackets 16 and 17 through the source pipe 166 inside the reception 125. The cooling-fluid fills up the volume and is nearly in direct contact with a wide surface to the beverage container 5 (not shown in this drawing). The fluid rises up to the drain hole 165 and flows back through the molded drain 162 and the pipe 167. The temperature sensor 63 is fixed inside the reception 125 in a hole in the outer jacket 16 and has direct contact to the inner jacket 17 and by this to the beverage inside the container 5. The keyhole 171 for the flange 52 is hereby embodied into the inner jacket 17.

In combination with the cooling unit 4 or the fluid-jacket-cooling according to FIGS. 8 and 9 the tub 15 or the inner jacket 17 can be designed with very thick aluminum walls. Due to this, a great cold capacity can be hold which, in combination with the excellent heat conductivity of aluminum, can be used to cool down a beverage container 5 very quickly by heat-exchange. This quick power-cooling cannot be done with any standard freezer-compressors in the same short period.

A passive cooling is possible according to FIGS. 3, 6 and 7. The cooling unit 4 is realized by a known cooling aid 49. The special insulation 11 allows to keep cool a beverage container 5 with only changing the cooling aid once or twice a day, even at high environment temperatures. A variant of the electronic controller 61 with one signal LED serves as a temperature surveillance and indicates a required change of the cooling aid 49. The position of the cooling aid 49 is on top of the flexible beverage container 5 and is not fixed, allowing the cooling aid 49 to stay in contact with the beverage surface while emptying the container. The inner part of the bonnet 13 includes a volume 133 for the cooling aid 49. The aluminium tub 15 and the cooling unit 4 are not needed in this sample. The cooling unit is replaced by an insulation.

The electronic controller 61 surveys the temperature inside the cooling volume. For this purpose a temperature sensor 63 is fixed to the tub 15, respectively to the inner jacket 17, respectively to the inner shell 14. The controller is equipped with an optical display, e.g. a control-LED 62 for the beverage temperature and a second one for the cooling liquid temperature. A text-display and a device for logging is also possible. The controller also secures the peltier element from overheating in case of a failure of the cooling circuit. Another possibility is the modification of the temperature limits by the operator.

Additionally the controller can be used as a timer to maintain the periodical mixing of the beverage by indicating the need to shake the container via the display-LEDs 62.

The tapping unit 3 is placed at the front face of the casing 1. According to FIGS. 1 to 7 it consists of a known tapping valve 31 that is fixed by a hump 311 to the flange 52 of the container 5.

There is an outlet tube 32 attachable to the valve 31. A lever 33 is provided for operation of the valve 31. This lever 33 can rotate in a reception 34 that is attached to the valve 31 by means of a notch-connection.

Figure 11:
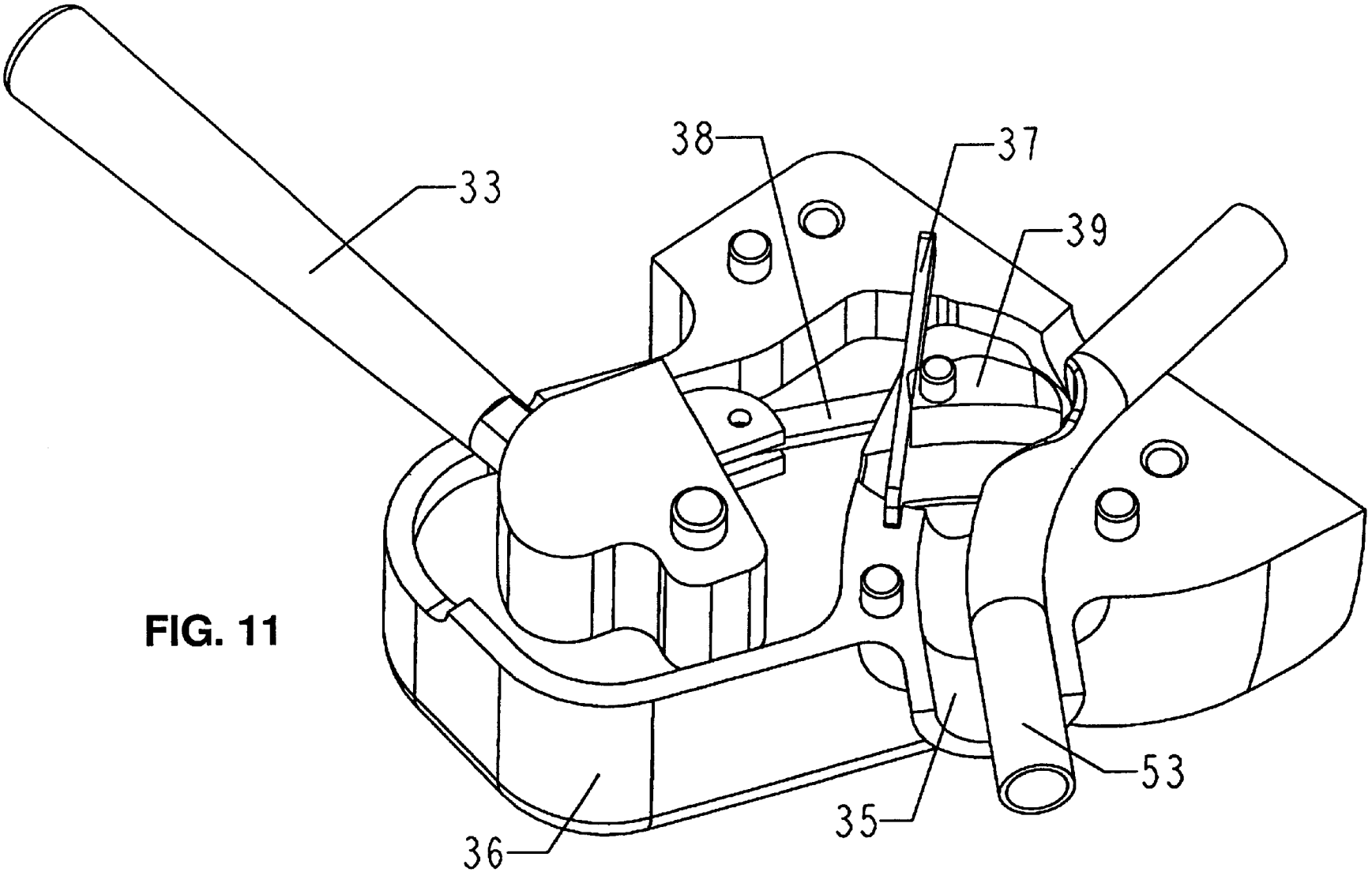
FIG. 11 the perspective view of a tapping unit using a tube clamp.

In FIG. 11 another type of tapping unit 3 is shown that is used if not a valve but a drain tube 53 is used with the container 5.

This tapping unit incorporates a passage 35 inside the housing 36 that holds the drain tube 53. The housing additionally holds a lever 33 that is guided by a leaf-spring 37. Due to the shape of the clamping notch 39 the lever can be moved between two fixed positions, full closed and full open. The linkage 38 transfers the movement of the lever 33 to the clamping notch 39 that blocks the drain tube 53 in the closed position.

A great advantage of these tapping units in comparison to pipe-cooling units is, that the beverage is not in contact with the device at any point. According to FIGS. 1 to 9 the beverage leaves the container via the flange 52 and the valve 31, which are supplied with each container, and the drain pipe 32 that can be washed or thrown away. According to FIG. 11 the beverage leaves the container directly via the drain tube 53. Due to this, there is no need for washing the device or parts of it. Especially in warm and humid regions this minimizes the danger of salmonellosis. The level of hygiene is remarkably higher.

The stand 2, shown in FIGS. 1 to 6 incorporates a middle part 21 with a tube fork 22 at its upper end. At its lower end a foot assembly 23 is attached to the middle part 21. This middle part 21 consists of a tube 211 provided with a bore 212 to hold a spring strut 213 that holds a ball shaped stop 214 at its free end. Additionally the tube 211 has two bores for attachment of the tube fork 22. At the upper end of the tube 211 a soft ball 216 is provided as a shock-absorbing backstop.

At both ends of the half-circular tube fork 22 a bearing assembly 221 is provided that consists of a bearing seat 222 and a ball bearing 223 on both sides of the device. These ball bearings carry the casing 1 in its bearing receptions 124 in the body 12. Due to this arrangement the casing 1 can pivot between the stop 214 and the backstop 216. The rest position can be defined by the position of the receptions 124 and the casings center of gravity, being either in contact with stop 124 or with backstop 126 according to FIG. 4 or 5.

The foot assembly consists of a dome 231 to which the tube 211 is fixed. A plate 232 is fixed to the bottom of the dome. This plate 232 holds four arms 233 that carry a ball-shaped soft foot 234 at their free ends. Alternatively the dome 231 or the middle part 21 can be fixed directly to a table or a bar.

The function of this device is described in the following. First, the bonnet 13 is taken from the casing 1.

Thereafter a beverage container 5 is inserted into the cooling volume inside of the tub 15 or the inner fluid jacket 17. The valve 31, that is connected to the container 5 via flange 52, is equipped with the tapping unit 3 consisting of the drain pipe 32, lever 33 and reception 34 and is inserted into the keyhole of the reception wall 18 or the opening 171 of the inner jacket 17.

When using the alternate tapping unit according to FIG. 11, the tube 53 provided with the container 5 is inserted into the passage 35 of the tapping unit 3. If a flange 52 is present at the container 5, it is inserted into the keyhole like previously mentioned.

Thereafter the bonnet 13 is reattached to the body 2. The container 5 is now totally enclosed into the casing 1 and its insulation 11.

The casing 1 has not to be opened for tapping and continuos cooling is provided by the cooling unit 4, regulated by the electronic controller unit 61. Thus we have an active cooling, that is surveyed by a display.

For tapping of juice that contains pulp the casing 1 has to be pivoted one or more times on its swiveling axis. By this movement the fruit pulp is mixed with the fluid. Furthermore this movement is used to improve the dispersion of temperature inside the beverage. Afterwards the juice can be tapped via the tapping unit 3.

What is claimed is:

1. A device for cooling of beverage containers that consists of a casing, integrates a cooling unit and a cooling volume and is to be closed by a bonnet, characterized in that the cooling volume is designed as a tub into which the beverage containers can be inserted, having contact to the tub on a wide surface, and characterized in that the casing (1) can be pivoted on a stand and the casing is equipped with a tapping unit.

2. The device according to claim 1, characterized in that the cooling unit is made of a peltier element and a water cooler, integrated into the swiveling casing.

3. The device according to claim 2, characterized in that the tub is made of aluminum.

4. The device according to claim 3, characterized in that the tub has very thick walls and is used as a fast dischargeable storage for coldness.

5. The device according to claim 2, characterized in that a temperature sensor is attached directly to the tub.

6. The device according to claim 5, characterized in that the temperature inside the cooling volume is shown to the user by means of an easy to interpret display.

7. The device according to claim 5, characterized in that the temperature range given by the target temperature and hysteresis, is adjustable or programmable.

8. The device according to claim 5, characterized in that the display can be used as an electronic, time-based shaking controller.

9. The device according to claims 1, characterized in that frozen beverage containers in a service box can be used as a source of coldness for cooling the device in an energy circuit.

10. The device according to claim 1, characterized in that the cooling unit is realized as a fluid-jacket-cooling that consists of an outer jacket and an inner jacket, integrated into the swiveling casing.

11. The device according to claim 10, characterized in that the tub is made of aluminum.

12. The device according to claim 11, characterized in that the tub has very thick walls and is used as a fast dischargeable storage for coldness.

13. The device according to claim 10, characterized in that a temperature sensor is attached directly to the inner jacket.

14. The device according to claim 1, characterized in that the casing is swivel-mounted to the stand.

15. The device according to claim 14, characterized in that the stand consists of a foot, a middle part, and a fork that produce a free usable space below the casing.

16. The device according to claim 14, characterized in that the stand is equipped with a shock-absorbing stop and backstop, defining the pivoting angle.

17. The device according to claim 1, characterized in that the casing integrates an insulation.

18. The device according to claims 1, characterized in that the beverage does not have any contact to the device, and thus reaches a very high standard of hygiene.

19. The device according to claim 1, characterized in that the cooling unit is realized as a cooling aid that is integrated into the swiveling casing.

20. The device according to claim 1, characterized in that the tapping unit consists of a valve, a lever and a reception.

21. The device according to one of claim 1, characterized in that the tapping unit integrates a housing, a passage and a lever.

22. The device according to claim 21, characterized in that the lever can be left in two fixed positions, aided by a leaf-spring and a prismatic clamping notch that opens and closes the drain tube of a beverage container.

23. The device according to claim 22, characterized in that the clamping notch is actuated by the lever via a linkage.

24. The device according to claim 1, characterized in that the tapping unit is arranged at the lower front face of the casing.

25. The device according to claim 1, characterized in that the body and the bonnet have the smallest possible cutout for integration of the tapping unit.

26. The device according to claim 1, characterized in that the body and the bonnet do not have a plain but an L-shaped division to ease the insertion and to fix the beverage containers at their flanges while shaking the casing.

27. The device according to claim 1, characterized in that the pivoting of the casing on its stand is used to improve the dispersion of temperature inside the beverage container.

* * * * *